US008920004B2

(12) United States Patent
Song et al.

(10) Patent No.: US 8,920,004 B2
(45) Date of Patent: Dec. 30, 2014

(54) OPTICAL SEMICONDUCTOR BASED ILLUMINATING APPARATUS

(75) Inventors: Tae Hoon Song, Seongnam (KR); Ji Wan Kim, Seongnam (KR)

(73) Assignee: Posco LED Company Ltd., Seongnam-si (KR)

( * ) Notice: Subject to any disclaimer, the term of this patent is extended or adjusted under 35 U.S.C. 154(b) by 170 days.

(21) Appl. No.: 13/596,834

(22) Filed: Aug. 28, 2012

(65) Prior Publication Data

US 2013/0170190 A1 Jul. 4, 2013

(30) Foreign Application Priority Data

Dec. 30, 2011 (KR) ..... 10-2011-0147879
Dec. 30, 2011 (KR) ..... 10-2011-0147880

(51) Int. Cl.
*F21V 15/00* (2006.01)

(52) U.S. Cl.
USPC ..... 362/365; 362/147; 362/249.02; 362/371; 362/373

(58) Field of Classification Search
USPC ..... 362/147–150, 249.02, 294, 364–364, 362/368–371, 373, 800
See application file for complete search history.

(56) References Cited

U.S. PATENT DOCUMENTS

| | | | | |
|---|---|---|---|---|
| 7,654,688 | B2 * | 2/2010 | Li et al. | 362/240 |
| 8,109,653 | B2 * | 2/2012 | Mo | 362/249.02 |
| 2010/0053950 | A1 * | 3/2010 | Higuchi et al. | 362/234 |

FOREIGN PATENT DOCUMENTS

| | | |
|---|---|---|
| JP | 2003-178602 | 6/2003 |
| JP | 2010-016003 | 1/2010 |
| JP | 2010-055938 | 3/2010 |
| JP | 2010-287400 | 12/2010 |
| JP | 4637251 | 12/2010 |
| JP | 2011-076979 | 4/2011 |
| JP | 2011-113940 | 6/2011 |
| JP | 2011-198582 | 10/2011 |
| JP | 2011-228098 | 11/2011 |
| JP | 2011-243536 | 12/2011 |
| KR | 20-0322121 | 8/2003 |
| KR | 20-0385916 | 6/2005 |
| KR | 10-2008-0098762 | 11/2008 |
| KR | 10-0926772 | 11/2009 |
| KR | 20-2010-0000837 | 1/2010 |
| KR | 20-0448152 | 3/2010 |
| KR | 10-1022071 | 3/2011 |
| KR | 10-2011-0110470 | 10/2011 |
| WO | 2011/005526 | 1/2011 |

* cited by examiner

*Primary Examiner* — Jason Moon Han
(74) *Attorney, Agent, or Firm* — H.C. Park & Associates, PLC

(57) ABSTRACT

An optical semiconductor illuminating apparatus capable of being simply installed and built, easily detecting a fault generation point, being simply repaired and replaced, and being compactly implemented. A bracket assembly having a power supply embedded therein is mounted at an upper side of a heat sink including a fixed unit, the power supply is seated on the heat sink including the fixed unit, a plurality of heat radiation fins protrude from an inner surface of the heat sink, and an upper surface of the power supply is disposed at a position higher than or equal to that of an edge of an upper end portion of the heat sink.

11 Claims, 7 Drawing Sheets

OPTICAL SEMICONDUCTOR BASED ILLUMINATING APPARATUS

CROSS-REFERENCE TO RELATED APPLICATION

This application claims priority from and the benefit of Korean Patent Application No. 10-2011-0147879, filed on Dec. 30, 2011, and No. 10-2011-0147880, filed on Dec. 30, 2011, which are hereby incorporated by reference for all purposes as if fully set forth herein.

BACKGROUND OF THE INVENTION

1. Field of the Invention

The present invention relates to an optical semiconductor based illuminating apparatus.

2. Discussion of the Background

An optical semiconductor such as a light emitting diode (LED) or a laser diode (LD) is one of the components that have been recently spotlighted widely as an illuminating apparatus due to lower power consumption, a longer lifespan, more excellent durability, and significantly higher brightness as compared with an incandescent lamp and a fluorescent lamp.

Recently, the optical semiconductor has tended to be utilized for downlight illumination.

In the downlight mainly having a form in which an illuminator is buried in a ceiling, the illuminator is hardly exposed, such that a ceiling surface is seen in a state in which it is properly arranged. Meanwhile, in the downlight, it is necessary to select an illuminator having an appropriate function and predict light distribution according to a required space presentation plan.

In the downlight as described above, a distance, an interval, and the like, should be necessarily observed by light distribution data suggested by a manufacturer in order to obtain a normal illumination effect.

However, since a downlight using an optical semiconductor, particularly, a power supply unit of the downlight is positioned at an upper side of a heat sink or a side of an illuminating apparatus, a wiring is complicated and exposed to the outside, such that it is difficult for a worker to perform work or the worker is exposed to an electrical risk.

Further, in the downlight using the optical semiconductor, the power supply may be mounted at the upper side of the heat sink. In this case, a space is insufficient at an upper side of a ceiling surface due to the power supply, such that there may also be a limitation in installing the downlight.

SUMMARY OF THE INVENTION

An object of the present invention is to provide an optical semiconductor illuminating apparatus capable of being simply installed and built, easily detecting a fault generation point, and being simply repaired and replaced.

Another object of the present invention is to provide an optical semiconductor illuminating apparatus capable of easily detecting a fault generation point, easily detecting a fault generation point, and being simply repaired and replaced, and being compactly implemented.

According to an exemplary embodiment of the present invention, there is provided an optical semiconductor illuminating apparatus including: a heat sink including a light emitting module disposed at a lower side thereof, the light emitting module including at least one semiconductor optical element; a fixed unit disposed at one side of the heat sink and fixed to a ceiling structure; a power supply disposed at an upper side of the heat sink; and a bracket assembly having the power supply embedded therein and mounted at the upper side of the heat sink.

The heat sink may include a heat radiation plate having the light emitting module disposed on a lower surface thereof and the fixed unit coupled thereto and heat radiation fins protruding radially from an upper surface of the heat radiation plate, and the power supply and the light emitting module may be electrically connected to each other while penetrating through the heat radiation plate.

The heat sink may further include a ring step formed to be stepped along an edge of the heat radiation plate.

The heat sink may further include at least one support piece protruding upwardly from an edge of the ring step, and the fixed unit may be coupled to the support piece.

The heat sink may further include: a ring step formed to be stepped along an edge of the heat radiation plate; an optical member having an edge seated on the ring step; and a ring shaped bezel formed along an edge of the optical member and coupled to the ring step.

The fixed unit may include a clip assembly coupled to a support piece protruding from an edge of a lower side of the heat sink to thereby be coupled to the ceiling structure.

The clip assembly may include: a support body contacting an outer surface of the support piece; and an acting body extended from an end portion of the support body so as to be inclined with respect to the support piece.

The clip assembly may further include: coil springs extended from both ends of the support body, respectively, and coupled to locking pieces protruding from both sides of a slit penetratedly formed at an upper side of the support piece so as to face each other; and clip pieces provided at end portions of the acting bodies.

The clip assembly may include: a moving piece coupled to a cut slit formed in a vertical length direction from an upper end portion of the support piece so that a position thereof is adjustable along the cut slit; a connection piece extended from an upper end portion of the moving piece and protruding outwardly of the support piece through the cut slit; and a clip piece fixed to the ceiling structure while being coupled to the connection piece and bent.

The clip assembly may include: a fixed piece coupled to a slot depressed downwardly from an upper end portion of the support piece; a hook piece extended from an end portion of the fixed piece and contacting an inner surface of the slot; and a clip piece extended from an upper end portion of the fixed piece and fixed to the ceiling structure while being bent with respect to an outer surface of the support piece.

The bracket assembly may include a lower body mounted at the upper side of the heat sink and supporting the power supply and an upper body coupled to the lower body, enclosing the power supply over the power supply, and coupled to the upper side of the heat sink.

The power supply may be electrically connected to the light emitting module through the lower body and the heat sink.

The heat sink may includes a heat radiation plate having the light emitting module disposed on a lower surface thereof and a hole formed to penetrate therethrough, and a plurality of heat radiation fins protruding radially from an upper surface of the heat radiation plate, the lower body may electrically connect the power supply and the light emitting module to each other through the hole, and the upper body may have an edge fixed to upper sides of the heat radiation fins.

The lower body may include: a lower case opened at an upper side thereof to allow the power supply to be seated thereon and having the upper body coupled to the upper side thereof and a tube body extended from a lower surface of the lower case to allow a cable for power connection to pass through the power supply up to the hole therethrough.

The upper body may include: an upper case opened at a lower side thereof to cover an upper surface of the power supply and coupled to the lower body; and a ring fixture extended from a side of the upper case and having a shape corresponding to a shape formed by edges of upper end portions of the plurality of heat radiation fins.

In addition, 'a semiconductor optical element' described in the claims and the detailed description means an element including or using an optical semiconductor such as a light emitting diode chip, or the like.

This 'semiconductor optical element' may be an element in a package level in which various kinds of optical semiconductors including the above-mentioned light emitting diode chip are included.

DETAILED DESCRIPTION OF THE ILLUSTRATED EMBODIMENTS

Hereinafter, exemplary embodiments of the present invention will be described with reference to the accompanying drawings.

Figure 1:
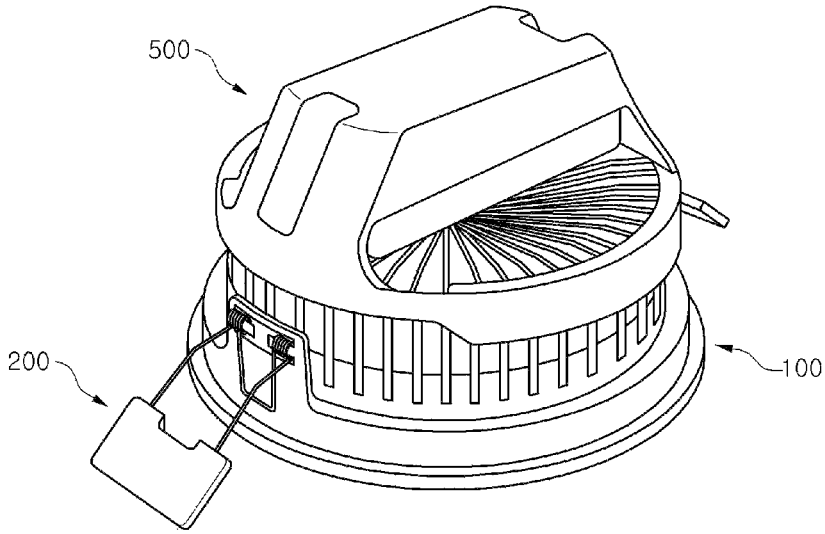
FIG. 1 is a perspective view showing the entire configuration of an optical semiconductor illuminating apparatus according to an exemplary embodiment of the present invention.
Figure 2:
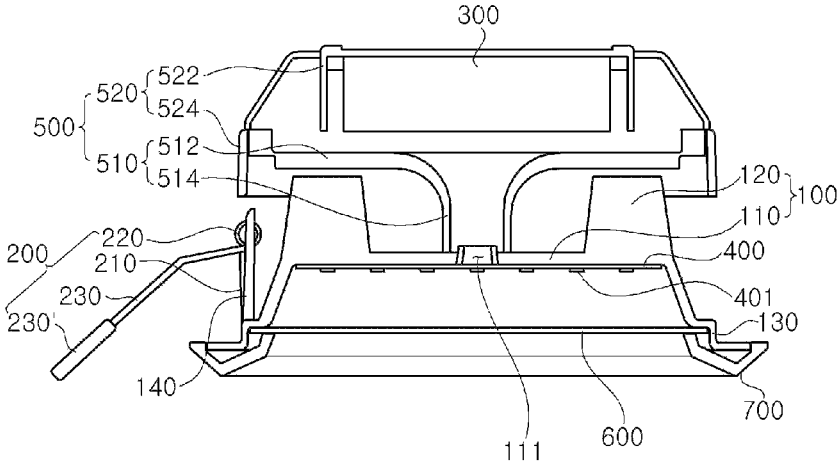
FIG. 2 is a cut-away cross-sectional perspective view showing the entire structure of an inner portion of the optical semiconductor illuminating apparatus according to the exemplary embodiment of the present invention.

FIG. 1 is a perspective view showing the entire configuration of an optical semiconductor illuminating apparatus according to an exemplary embodiment of the present invention; FIG. 2 is a cut-away cross-sectional perspective view showing the entire structure of an inner portion of the optical semiconductor illuminating apparatus according to the exemplary embodiment of the present invention; and FIG. 3 is an exploded perspective view showing the entire configuration of the optical semiconductor illuminating apparatus according to the exemplary embodiment of the present invention.

Figure 3:
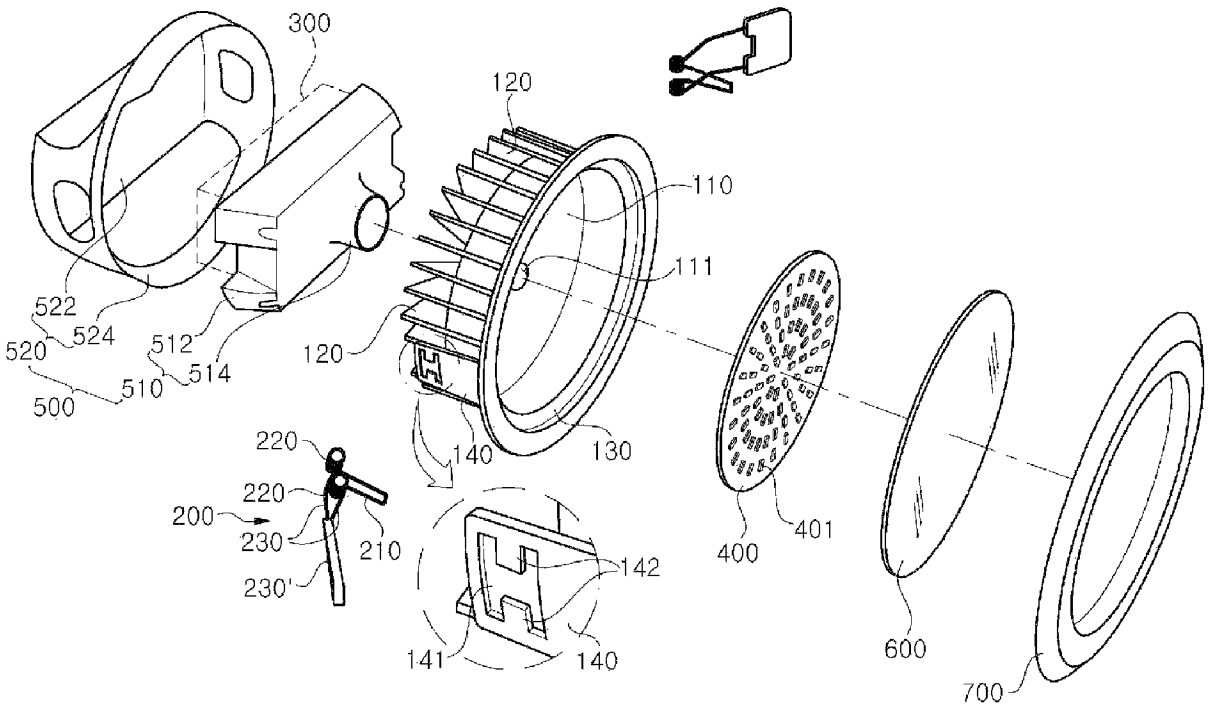
FIG. 3 is an exploded perspective view showing the entire configuration of the optical semiconductor illuminating apparatus according to the exemplary embodiment of the present invention.

It may be appreciated that the optical semiconductor illuminating apparatus according to the exemplary embodiment of the present invention has a configuration in which a bracket assembly 500 having a power supply 300 embedded therein is mounted at an upper side of a heat sink 100 including a fixed unit 200, as shown in FIGS. 1 to 3.

First, the heat sink 100, which includes a light emitting module 400 disposed at a lower side thereof and including at least one semiconductor light element 401, is to solve a problem associated with heat generated from the light emitting module 400.

The fixed unit 200 is disposed at one side of the heat sink 100 and is fixed to a ceiling structure (not shown).

The power supply 300 is disposed at the upper side of the heat sink 100 and supplies power to the light emitting module 400.

The bracket assembly 500, which has the power supply 300 embedded therein and is mounted at the upper side of the heat sink 100, may be detachably coupled to the upper side of the heat sink 100 so that it is easily replaced or repaired at the time of generation of a fault thereof.

Here, the detachable coupling of the bracket assembly 500 may be made using a fastener such as a bolt, or the like. However, a scheme of detachably coupling the bracket assembly 500 to the upper side of the heat sink 100 is not limited thereto, but may be variously modified and applied. For example, the bracket assembly may be coupled to the upper side of the heat sink 100 in a press-fitting scheme, or the like.

According to the present invention, the example as described above may be applied, and various examples as follows may also be applied.

The heat sink 100, which is provided in order to solve the problem associated with the heat generated from the light emitting module 400, may include a heat radiation plate 110 and heat radiation fins 120.

The heat radiation plate 110 is a member having the light emitting module 400 disposed on a lower surface thereof and the fixed unit 200 coupled thereto, and the heat radiation fins 120 are a plurality of members protruding radially from an upper surface of the heat radiation plate 100.

Here, the power supply 300 and the light emitting module 400 are electrically connected to each other through a hole 111 in the heat radiation plate 110.

Here, the heat sink 100 may further include a ring step 130 formed to be stepped along an edge of the heat radiation plate 110 and at least one support piece protruding upwardly from an edge of the ring step 130.

An edge of an optical member 600 is seated on the ring step 130, and a ring shaped bezel 700 is disposed along an edge of the optical member and is coupled to the ring step 130.

In addition, the fixed unit 200 may be coupled to the support piece 140.

Meanwhile, the fixed unit 200 is to be easily fixed to the ceiling structure as described above. An example of the fixed unit 200 including a clip assembly coupled to the support piece 140 to thereby be coupled to the ceiling structure may be applied.

First, an example of the clip assembly using elastic support force of a spring as shown in FIGS. 1 to 3 may be applied.

That is, the clip assembly includes a support body 210, coil springs 220, acting bodies 230, and clip pieces 230'.

The support body 210 contacts an outer surface of the support piece 140 to serve as a support point of a lever.

The coil springs 220 are extended from both ends of the support body 210, respectively, and are coupled to locking pieces 142 protruding from both sides of a slit 141 penetrately formed at an upper side of the support piece 140 so as to face each other.

The acting bodies 230 are extended from end portions of each of the coil springs 220 so as to be inclined with respect to the support piece 140, and the clip pieces 230' are provided at end portions of the acting bodies 230.

Therefore, the coil assembly may be maintained in a state in which it is certainly fixed by pulling the acting bodies 230 so as to be close to the support body 210 by elastic repulsive force of the coil springs 220 acting in a direction that becomes distant from the support piece 140 and then fixing the clip pieces 230' to the ceiling structure.

Figure 4:
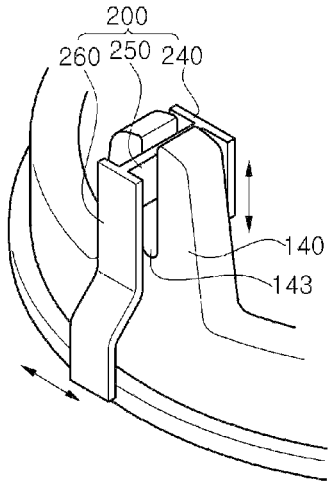
FIGS. 4 and 5 are perspective views showing a fixed unit, which is a main part of an optical semiconductor illuminating apparatus according to various exemplary embodiments of the present invention.

In addition, as shown in FIG. 4, an example of the clip assembly in which a clip piece 260 bent while being coupled to a connection piece 250 extended from an upper end portion of a moving piece 240 coupled to a cut slit 143 formed in a vertical length direction from an upper end portion of the support piece 140 so that a position thereof is adjustable along the cut slit 143 and protruding outwardly of the support piece 140 through the cut slit 143 is fixed to the ceiling structure may also be applied.

Figure 5:
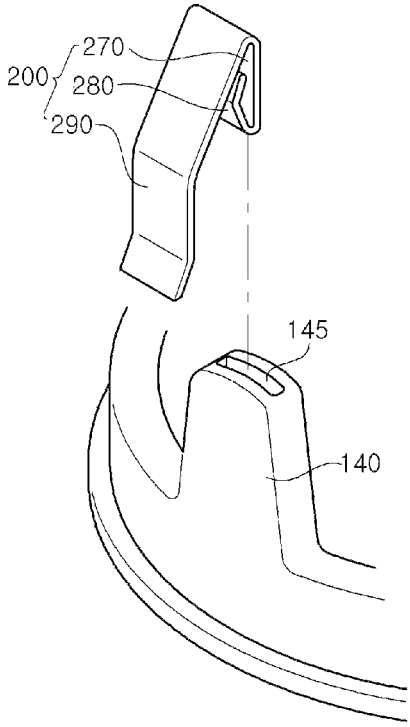

Further, as shown in FIG. 5, an example of the clip assembly in which a hook piece 280 extended from an end portion of a fixed piece 270 coupled to a slot 145 depressed downwardly from an upper end portion of the support piece 140 contacts an inner surface of the slot 145 and a clip piece 290 extended from an upper end portion of the fixed piece 270 is fixed to the ceiling structure while being bent with respect to an outer surface of the support piece 140 may also be applied.

Meanwhile, the bracket assembly 500, which has the power supply 300 embedded therein and is mounted at the upper side of the heat sink 100 as described above, may largely include a lower body 510 and an upper body 520.

The lower body 510 is a member mounted at the upper side of the heat sink 100 and supporting the power supply 300, and the upper body 520 is a member coupled to the lower body 510, enclosing the power supply 300 over the power supply 300, and coupled to the upper side of the heat sink 100.

Here, the power supply 300 is electrically connected to the light emitting module 400 through the lower body 510 and the heat sink 100.

Here, the lower body 510 electrically connects the power supply 300 and the light emitting module 400 to each other through the hole 111, and the upper body 520 has an edge fixed to upper sides of the heat radiation fins 120.

Describing the lower body 510 in detail, the lower body 510 includes a lower case 512 opened at an upper side thereof to allow the power supply 300 to be seated thereon and having the upper body 520 coupled to the upper side thereof and a tube body 514 extended from a lower surface of the lower case 512 to allow a cable (not shown) for power connection to pass through the power supply 300 up to the hole 111 therethrough.

Describing the upper body 520 in detail, the upper body 520 includes an upper case 522 opened at a lower side thereof to cover an upper surface of the power supply 300 and coupled to the lower body 510 and a ring fixture 524 extended from a side of the upper case 522 and formed to have a shape corresponding to a shape formed by edges of upper end portions of a plurality of heat radiation fins 120 to thereby be detachably coupled to the edges of the upper end portions of the plurality of heat radiation fins 120.

Figure 6:
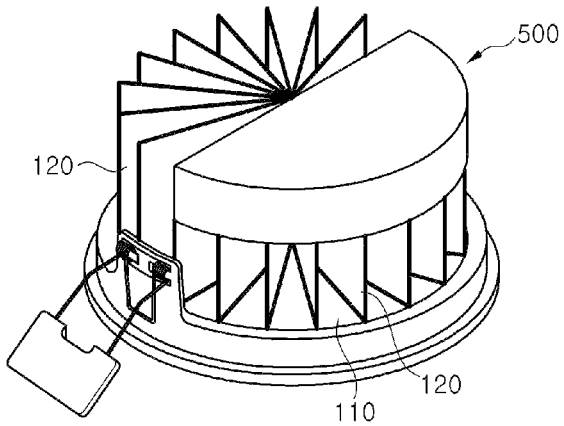
FIGS. 6 and 7 are perspective views showing a bracket assembly, which is a main part of the optical semiconductor illuminating apparatus according to various exemplary embodiments of the present invention.

Meanwhile, in addition to the example as described above, the bracket assembly 500 is mounted on a portion having a step in some of the plurality of radiation fins 120 formed on the heat radiation plate 110, as shown in FIG. 6, thereby making it possible to reduce the entire height.

Figure 7:
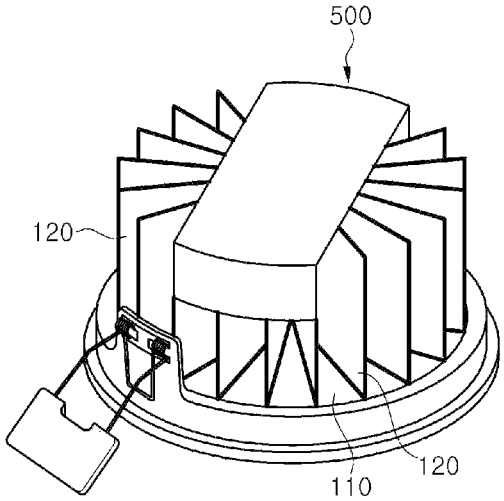

Further, the bracket assembly 500 is mounted on a portion formed to be low in a groove shape while traversing upper sides of the plurality of heat radiation fins 120, as shown in FIG. 7, thereby making it possible to reduce the entire height.

Meanwhile, according to the present invention, in addition to the example as described above, examples as shown in FIGS. 8 to 12 may also be applied.

Figure 8:
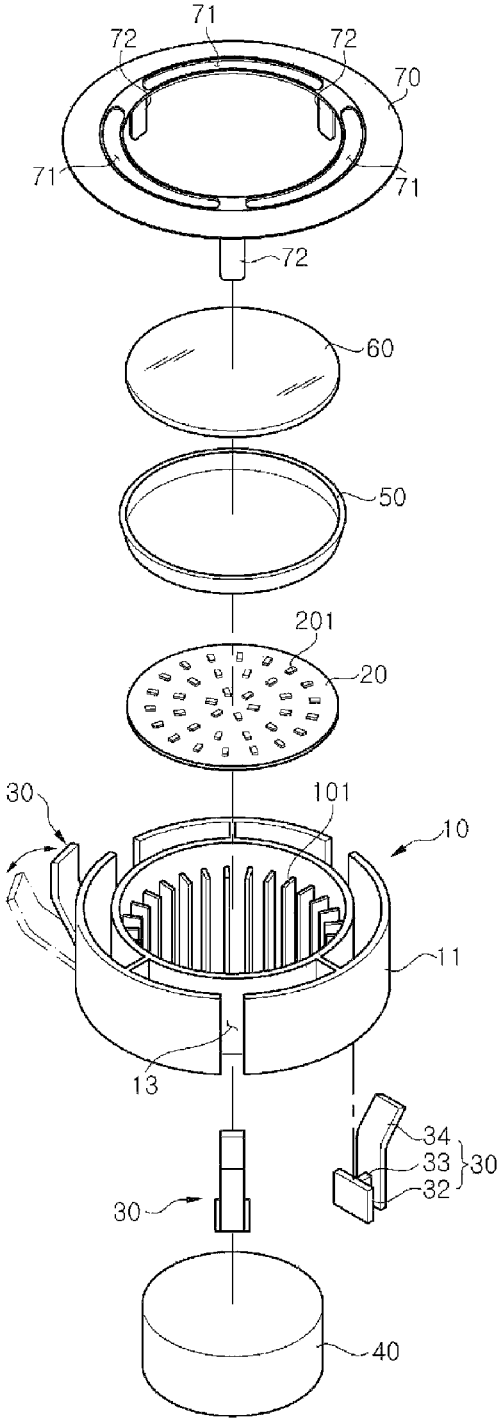
FIGS. 8 to 12 are conceptual diagrams of a structure of the optical semiconductor illuminating apparatus according to various exemplary embodiments of the present invention.

It may be appreciated that the optical semiconductor illuminating apparatus according to the exemplary embodiment of the present invention has a configuration in which a power supply 40 is seated on a heat sink 10 including a fixed unit 30 and a plurality of heat radiation fins 101 protrude from an inner surface of the heat sink 10, as shown in FIG. 8.

The heat sink 10, which is opened at an upper side thereof and includes the plurality of heat radiation fins 101 protruding toward the center along the inner surface thereof, is to solve a problem associated with heat generated from a light emitting module 20 to be described below.

The light emitting module 20 is formed at a lower side of the heat sink 10 and includes at least one semiconductor optical element 201.

The fixed unit 30 is disposed at one side of the heat sink 10 and is fixed to a ceiling structure (not shown).

The power supply 40 is disposed at an upper side of the heat sink 10 and is electrically connected to the light emitting module to supply power to the light emitting module 20.

Here, an upper surface of the power supply 40 may be disposed at a position higher than or equal to that of an edge of an upper end portion of the heat sink 10 so as to reduce the entire height to secure an installation space.

In this case, the power supply 40 is disposed to be spaced apart from the upper side of the heat sink 10 by a predetermined distance, such that convection is generated in a space between the power supply 40 and the heat sink 10 that are spaced apart from each other, thereby making it possible to further improve heat radiation efficiency.

The heat sink 10, which is provided to solve the problem associated with the heat generated from the light emitting module 20 as described above, includes the power supply 40 mounted at the upper side thereof, the light emitting module 20 disposed at a lower side thereof, the fixed unit 20 coupled to an outer side thereof, and a vertical penetration type body 11.

Figure 9:
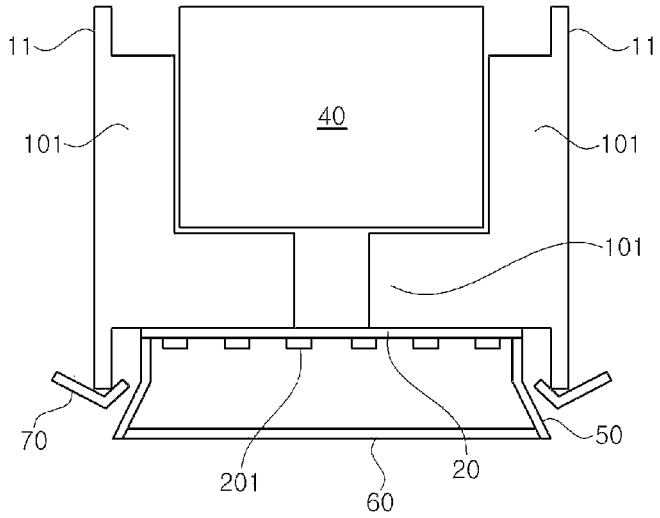

Here, an example of a structure in which an upper side of the heat radiation fin 101 is extended up to an outer surface of the power supply 40 and a lower side thereof is extended toward a central portion of the body 11 to support a lower surface of the power supply 40 as shown in FIG. 9 may be applied.

Figure 10:
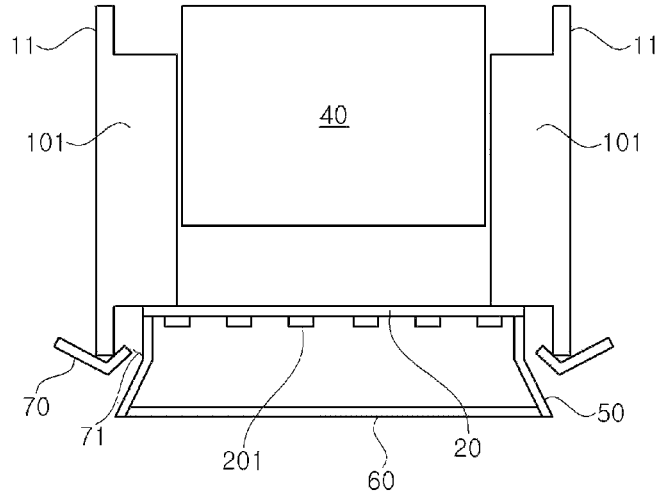

In addition, an example of a structure in which the heat radiation fin 101 is extended up to an outer surface of the power supply 40 as shown in FIG. 10 may also be applied.

Meanwhile, the heat sink 10 further includes a reflector 50 disposed along an edge of the light emitting module 20, a diffuser 60 coupled to an edge of the reflector 50, and a ring shaped bezel 70 formed at an edge of the diffuser 60 and coupled to a lower side of the body 11.

Here, the bezel 70 may further include at least one vent slit 71 penetratedly formed along an edge thereof to be in communication with a space formed by an inner surface of the body 11 and the heat radiation fins 101, in order to further increase heat radiation efficiency through convection circulation of air.

In addition, the heat sink 10 may further include at least one rail 13 formed from an edge of an upper end portion of the body 11 up to an edge of a lower end portion of the body 11 along an outer surface of the body 11 in a vertical length direction.

In addition, a coupling piece 72 protruding along an edge of the bezel 70 at a position corresponding to that of the rail 13 is coupled to the rail 13, such that the bezel 70 is fixed to the body 11.

In addition, a lower end portion of the heat radiation fin 101 is disposed to be spaced apart from an edge of a lower end portion of the body 11 in an upward direction, thereby making it possible to improve a hot spot so that a semiconductor optical element 201 of the light emitting module 20 is not recognized as a point light source.

That is, the light emitting module 20 and the diffuser 60 are spaced apart from each other by a distance corresponding to a height of the reflector 50, thereby making it possible to allow light irradiated from the light emitting module 20 to be seen in a surface light source form.

Figure 11:
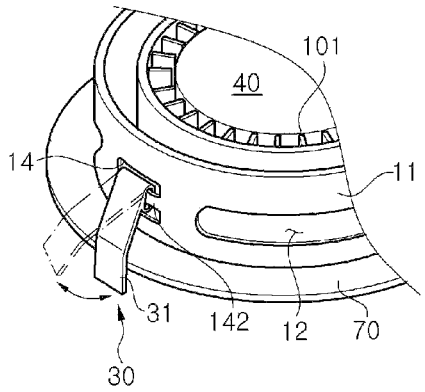

In addition, the heat sink 10 may further include at least one heat radiation slot 12 penetratedly formed along an outer surface of a lower side of the body 11 so as to improve heat radiation efficient and heat discharge, as shown in FIG. 11.

Meanwhile, the fixed unit 30 is to be fixed to the ceiling structure as described above. An example of the fixed unit 30 including a clip piece 31 coupled to locking pieces 142 protruding from both sides of an auxiliary slot 14 penetratedly formed between the heat radiation slots 12 so as to face each other to thereby rotate and a spring (not shown) elastically supporting the clip piece 31 as shown in FIG. 11 may be applied.

Therefore, the clip piece 31 may be maintained in a state in which it is certainly fixed by being pulled toward the heat sink 10 by elastic repulsive force of the spring acting in a direction that becomes distant from the heat sink 10 and being then fixed to the ceiling structure.

In addition, referring to FIG. 8, an example of the fixed unit 30 coupled to the rail 13 so that a position thereof is adjustable according to a direction in which the rail 13 is formed may be applied.

That is, an example of the fixed unit 30 in which a clip piece 34 coupled to a connection piece 33 extended from an upper end portion of a moving piece 32 coupled to the rail 13 so that a position thereof is adjustable and protruding outwardly of the heat sink 10 through the rail 13 is fixed to the ceiling structure while being bent may be applied.

Figure 12:
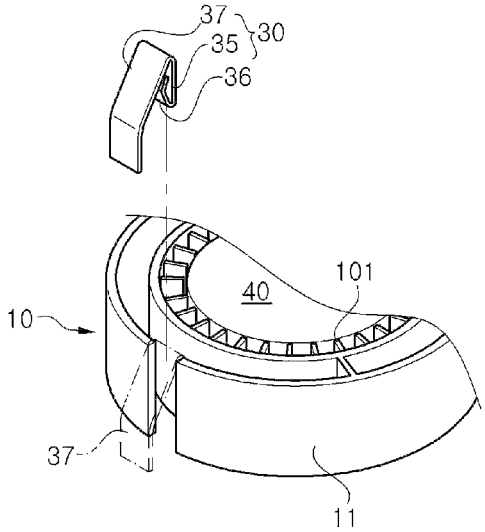

Further, referring to FIG. 12, an example of the fixed unit 30 in which a hook piece 36 extended from an end portion of a fixed piece 35 coupled to the rail 13 is fitted into an inner surface of the rail 13 and a clip piece 37 extended from an upper end portion of the fixed piece 35 is fixed to the ceiling structure while being bent with respect to an outer surface of the heat sink 10 may also be applied.

As described above, according to the exemplary embodiment of the present invention, it is possible to provide the optical semiconductor illuminating apparatus capable of being simply installed and built, easily detecting a fault generation point, being simply repaired and replaced, and being compactly implemented.

As set forth, according to the exemplary embodiment of the present invention, the bracket assembly having the power supply embedded therein is mounted at the upper side of the heat sink, thereby making it possible to provide an optical semiconductor illuminating apparatus capable of being simply installed and built, easily detecting a fault generation point, and being simply repaired and replaced so as to be applied to the downlight.

In addition, according to the exemplary embodiment of the present invention, the upper surface of the power supply seated on the heat sink and electrically connected to the light emitting module is disposed at a position higher than or equal to that of the edge of the upper end portion of the heat sink, thereby making it possible to provide an optical semiconductor illuminating apparatus capable of easily detecting a fault generation point, being simply repaired and replaced, and being compactly implemented.

In addition, various modifications and applications may be made by those skilled in the art without departing from the scope of the basic technical spirit of the present invention. For example, the optical semiconductor illuminating apparatus according to the exemplary embodiment of the present invention may be utilized for outdoor illumination such as landscape illumination, or the like, in any installation environment in which there is a fixed structure, in addition to the downlight illumination.

What is claimed is:

1. An optical semiconductor illuminating apparatus, comprising:

a heat sink comprising a light emitting module disposed on a lower side thereof, the light emitting module comprising at least one semiconductor optical element;

a fixed unit disposed at one side of the heat sink and configured to be fixed to a ceiling structure;

a power supply disposed on an upper side of the heat sink; and a bracket assembly having the power supply embedded therein and mounted at the upper side of the heat sink, wherein:

the bracket assembly comprises:

a lower body mounted at the upper side of the heat sink and supporting the power supply; and an upper body, coupled to the lower body, enclosing the power supply over the power supply and coupled to the upper side of the heat sink;

the heat sink comprises:

a heat radiation plate having the light emitting module disposed on a lower surface thereof;

a hole penetrating through the heat radiation plate; and heat radiation fins protruding radially from an upper surface of the heat radiation plate;

the lower body electrically connects the power supply and the light emitting module to each other through the hole; and the lower body comprises:

a lower case opened at an upper side thereof to allow the power supply to be seated thereon and having the upper body coupled to the upper side thereof; and a tube body extended from a lower surface of the lower case and configured to allow a cable for power connection to pass from the power supply to the light emitting module through the hole.

2. The optical semiconductor illuminating apparatus of claim 1, wherein the heat sink further comprises a ring step formed along an edge of the heat radiation plate.

3. The optical semiconductor illuminating apparatus of claim 2, wherein:

the heat sink further comprises at least one support piece protruding upwardly from an edge of the ring step; and the fixed unit is coupled to the support piece.

4. The optical semiconductor illuminating apparatus of claim 1, wherein the heat sink further comprises:

a ring step formed along an edge of the heat radiation plate;

an optical member having an edge seated on the ring step; and a ring shaped bezel formed along an edge of the optical member and coupled to the ring step.

5. The optical semiconductor illuminating apparatus of claim 1, wherein the fixed unit comprises a clip assembly coupled to a support piece protruding from an edge of a lower side of the heat sink and configured to be coupled to the ceiling structure.

6. The optical semiconductor illuminating apparatus of claim 5, wherein the clip assembly comprises:

a support body contacting an outer surface of the support piece; and an acting body extended from an end portion of the support body so as to be inclined with respect to the support piece.

7. The optical semiconductor illuminating apparatus of claim 6, wherein the clip assembly further comprises:

coil springs extended from both ends of the support body, respectively, and coupled to locking pieces protruding from both sides of a slit penetratedly formed at an upper side of the support piece so as to face each other; and clip pieces provided at end portions of the acting bodies.

8. The optical semiconductor illuminating apparatus of claim 5, wherein the clip assembly includes:

a moving piece coupled to a cut slit formed in a vertical length direction from an upper end portion of the support piece so that a position thereof is adjustable along the cut slit;

a connection piece extended from an upper end portion of the moving piece and protruding outwardly of the support piece through the cut slit; and a clip piece fixed to the ceiling structure while being coupled to the connection piece and bent.

9. The optical semiconductor illuminating apparatus of claim 5, wherein the clip assembly includes:

a fixed piece coupled to a slot depressed downwardly from an upper end portion of the support piece;

a hook piece extended from an end portion of the fixed piece and contacting an inner surface of the slot; and a clip piece extended from an upper end portion of the fixed piece and fixed to the ceiling structure while being bent with respect to an outer surface of the support piece.

10. The optical semiconductor illuminating apparatus of claim 1, wherein the upper body has an edge fixed to upper sides of the heat radiation fins.

11. The optical semiconductor illuminating apparatus of claim 1, wherein the upper body comprises:

an upper case opened at a lower side thereof and configured to cover an upper surface of the power supply and coupled to the lower body; and a ring fixture extended from a side of the upper case and having a shape corresponding to a shape formed by edges of upper end portions of the plurality of heat radiation fins.

* * * * *